United States Patent [19]

Baker et al.

[11] Patent Number: 4,854,386

[45] Date of Patent: Aug. 8, 1989

[54] METHOD AND APPARATUS FOR STAGE CEMENTING A LINER IN A WELL BORE HAVING A CASING

[75] Inventors: Samuel F. Baker, Conroe; Britt O. Braddick, Houston, both of Tex.

[73] Assignee: Texas Iron Works, Inc., Houston, Tex.

[21] Appl. No.: 226,898

[22] Filed: Aug. 1, 1988

[51] Int. Cl.[4] ..... E21B 33/14

[52] U.S. Cl. ..... 166/289; 166/291; 166/123; 166/156; 166/181

[58] Field of Search ..... 166/289, 291, 116, 123, 166/125, 153, 154, 156, 181, 185, 193

[56] References Cited

U.S. PATENT DOCUMENTS 4,060,131 11/1977 Kennedy et al. ..... 166/156 X 4,450,912 5/1984 Callihan et al. ..... 166/289

*Primary Examiner*—William P. Neuder

*Attorney, Agent, or Firm*—Jack W. Hayden

[57] ABSTRACT

The present invention relates to a method and apparatus for cementing a liner in a well bore having a casing wherein the liner is connected to a running tool and includes hanger means for securing the liner to the casing in the well bore. The liner includes an upper and lower liner portion each having port means therein and means to lock the telescoping liner portions against relative longitudinal movement to prevent premature actuation or operation of the port means.

The liner portions provide a mechanically actuated port arrangement to be employed with first and second liner wiper means and first and second pump down plug means for cementing above a packer on the lower liner portion, or for providing dual stage cementing.

47 Claims, 9 Drawing Sheets

FIG. 12
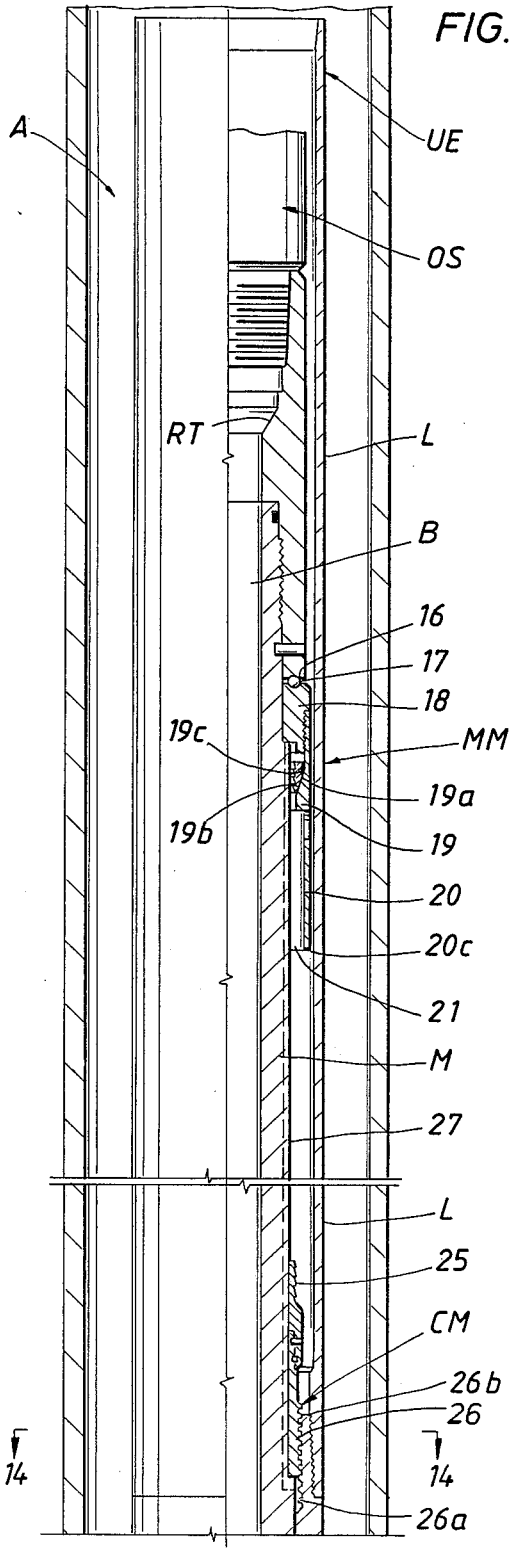
FIG. 13
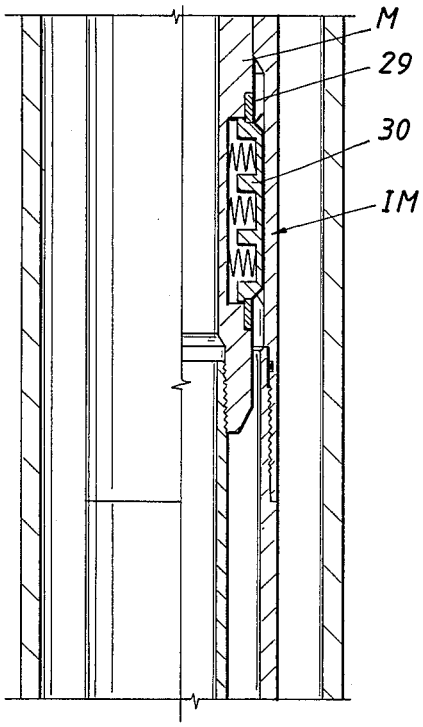
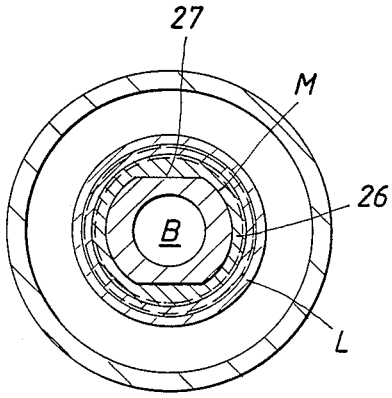
FIG. 14

METHOD AND APPARATUS FOR STAGE CEMENTING A LINER IN A WELL BORE HAVING A CASING

STATEMENT OF THE PRIOR ART

Cementing and stage cementing of tubular members in a well bore has heretofore been accomplished by various methods and apparatus. When stage cementing operations have been performed, it has been common practice to employ hydraulically operated port collars which may be selectively opened and closed hydraulically for discharge of cement from the tubular member or liner into the well bore.

In single stage cementing of liners in well bores where the cement is discharged out the lower end of the liner and into the well bore, it has been common practice to rotate and reciprocate the liner both before and during the cementing operation in order to accomplish a better cementing result.

In stage cementing of tubular members in a well bore, such as a production string, it has been proposed to provide telescoping sections in the drill string with port means to enable cement to be discharged through the telescoping members and into the drill string. Such telescoping members include means to hold the members against relative longitudinal movement in one direction, but accommodate free relative movement in the other direction. In addition to the port means between the telescoping sections, the lower tubular member is provided with a lower open end so that cement may be discharged therethrough and into the well bore for cementing the lower telescoping tubular section in the well bore. After such operation, the upper tubular member can be lowered to open the port means for discharging cement therethrough and in this stage the upper tubular telescoping member can be rotated and reciprocated while the cement is discharged in order to obtain a desirable cementing operation.

Such arrangement is illustrated in U.S. Pat. No. 4,751,967.

Well bores for producing hydrocarbons, such as oil and gas, are seldom, if ever, straight vertical holes in the earth's formation. For example, they may actually be in the form of a cork screw, they may contain "dog legs" or ledges which project laterally of the well bore so that movement of tubular member therethrough, including tubular members such as liners, may be impeded or restricted. In such event, the construction illustrated in the above patent may prematurely open the port means which may cause undesirable results.

Also, while deviated well bores, those extending at a angle relative to the vertical, have been common in drilling of oil and gas wells, such procedure is becoming even more common. Well bores which are near horizontal, near horizontal or at a high angle of deviation are becoming more acceptable. Where a well bore is at horizontal, near horizontal or at a high angle of deviation, a greater extent of producing formation may be penetrated by the well bore than is possible if the well bore is drilled in the customary fashion.

Also, some producing formations are more compact or consolidated which may impede the flow of hydrocarbons from the formation and it may be desirable to seal off the formation from the remainder of the well bore without providing cement in the well bore adjacent the formation to provide as little resistance as possible to hydrocarbon flow.

The angle of such holes further causes the well pipe and liner that is lowered therein to rest on one side of the well bore relative to the other and this friction may impede the movement of the pipe so that if port means are present between telescoping sections, such port means may be prematurely opened, or it may not be as readily known at the earth's surface whether the port means is open or closed at a particular stage of the operation.

In addition, the threaded nut means normally employed between a mandrel, or running tool member and a liner to secure the liner with the running tool while lowering it into position in the well bore is rotated by the running tool member or mandrel so as to disconnect the threaded nut from the liner so that the running tool may be retrieved. In a highly deviated well bore, or in one that is horizontal or substantially horizontal, there may be some tendency for the operating string that is connected with the running tool to cork screw during the release of the connecting nut between the liner and the running tool member. In such event, there may be tendency to rotate the operating string, or the running tool member in a manner so as to tend to reengage the threaded nut with the liner.

Further, as previously noted, hydraulically actuated port collars have heretofore generally been employed in stage cementing operations. Where a packer is employed with a tubular member such as a liner in stage cementing a well bore, the packer is generally hydraulically set, the port means is hydraulically opened and hydraulically closed, and then hanger means for hanging the liner on the casing in the well bore may be hydraulically actuated. Some operators may prefer to reduce the number of hydraulic operations conducted in the well bore.

CROSS REFERENCE TO RELATED APPLICATION

In part, the subject matter of this application relates to the liner wiper and pump down plug arrangement disclosed in prior co-pending application Ser. No. 07/147,701 filed Dec. 4, 1987 for "Cementing Method and Arrangement", which is assigned to the assignee of this application.

SUMMARY OF THE INVENTION

The present invention provides a method and apparatus for overcoming the above objections and problems.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means and wherein hydraulically actuated seal means of unique configuration are employed on the setting tool for sealably engaging with the liner and such hydraulically actuated seal means moves therethrough during the cementing operations that cement the liner is position in the well bore.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means and wherein hydraulically actuated seal means of unique configuration are employed on the setting tool for sealably engaging with the liner and such hydraulically actuated seal means moves therethrough during the cementing operations that cement the liner in position in the well bore and wherein the lower liner portion includes a hydraulically inflatable packer which may be inflated to sealingly engage with the well bore wall to secure the lower liner portion in position in the well bore and seal off the portion of the well bore therebeneath from the portion of the well bore thereabove.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means and wherein hydraulically actuated seal means of unique configuration are employed on the setting tool for sealably engaging with the liner and such hydraulically actuated seal means moves therethrough during the cementing operations that cement the liner in position in the well bore and wherein the lower liner portion includes a hydraulically inflatable packer which may be inflated to sealingly engage with the well bore wall to secure the lower liner portion in position in the well bore and seal off the portion of the well bore therebeneath from the portion of the well bore thereabove whereupon the upper liner portion may be manipulated by the running tool and operating string connected therewith to unlock the upper liner portion relative to the lower liner portion so that the port means in the upper liner portion may communicate with the well bore above the packer for discharging cement from the liner into the well bore.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means and wherein hydraulically actuated seal means of unique configuration are employed on the setting tool for sealably engaging with the liner and such hydraulically actuated seal means moves therethrough during the cementing operations that cement the liner in position in the well bore and wherein the lower liner portion includes a hydraulically inflatable packer which may be inflated to sealingly engage with the well bore wall to secure the lower liner portion in position in the well bore and seal off the portion of the well bore therebeneath from the portion of the well bore thereabove whereupon the upper liner portion may be manipulated by the running tool and operating string connected therewith to unlock the upper liner portion relative to the lower liner portion so that the port means in the upper liner portion may communicate with the well bore above the packer for discharging cement from the liner into the well bore, the manipulation of the operating string and running tool to lock the upper liner portion being accomplished by relative rotation between the upper liner portion and the lower liner portion secured in the well bore.

Another object of the present invention is to provide a method and apparatus for cementing a liner in a well bore having a casing wherein the liner is connected to a running tool and includes hanger means for securing the liner to the casing in the well bore, the liner including an upper and lower liner portion each having port means therein, and means to lock the telescoping liner portions against relative longitudinal movement to prevent premature actuation or operation of the port means and wherein hydraulically actuated seal means of unique configuration are employed on the setting tool for sealably engaging with the liner and such hydraulically actuated seal means moves therethrough during the cementing operations that cement the liner in position in the well bore and wherein the lower liner portion includes a hydraulically inflatable packer which may be inflated to sealingly engage with the well bore wall to secure the lower liner portion in position in the well bore and seal off the portion of the well bore therebeneath from the portion of the well bore thereabove whereupon the upper liner portion may be manipulated by the running tool and operating string connected therewith to unlock the upper liner portion relative to the lower liner portion so that the port means in the upper liner portion may communicate with the well bore above the packer for discharging cement from the liner into the well bore, the manipulation of the operating string and running tool to lock the upper liner portion being accomplished by relative rotation between the upper liner portion and the lower liner portion secured in the well bore, there being bearing means between the upper and lower liner portions for accommodating relative rotation of the upper liner portion to the lower liner portion after the lower liner portion has been secured in the well.

A further object of the present invention is to provide a running tool for stage cementing a liner which has upper and lower telescoping liner portions with port means therein and cooperating surface means to releasably lock the liner portions against relative longitudinal movement in either direction and thereby avoid premature communication with the well bore through the port means in the upper liner portion including, a member having a longitudinal bore therethrough, releasable connecting means for releasably connecting the running tool member to the liner to enable the running tool to manipulate and disengage the liner portion surface means and open the port means in the upper liner portion and also to reengage the liner portion surface means and lock the liner portions against relative longitudinal movement and close the port means in the upper liner portion, inhibiting means to inhibit premature actuation of said releasable connecting means and premature disconnection from the liner, retrievable seal means sealing between said running tool member and the liner to accommodate axial movement of said running tool member relative to the retrievable seal means while avoiding communication between the inside and outside of the liner throughout the length of the liner below said retrievable seal means and above where cement is discharged from the liner into the well bore, the releasable connecting means being in the form of threaded nut means thereon and connecting the running tool member to the liner, the threaded nut means being disconnectable from the liner upon relative rotation between the running tool member and liner, segmented nut means supported on the running tool member and longitudinally spaced relative to the threaded nut means, said threaded nut means having surface means engageable with said segmented nut means upon disengagement of the threaded nut means from the liner along with longitudinal movement of said running tool member relative to the liner to connect said threaded nut means and segmented nut and thereby inhibit reengagement of said threaded nut means with the liner, and hydraulically actuated seal means supported by the running tool member for sealing with the liner.

Yet still a further object of the present invention is to provide an apparatus of the foregoing immediate object wherein the inhibiting means includes groove means in the liner and spring actuated lug means on the running tool member for engaging in the groove means to inhibit relative rotation between the liner and setting tool member and to accommodate co-rotation of the liner and running tool member.

A further object is to provide means for engaging and retaining a threaded nut when disconnected form a liner to inhibit the threaded nut from reengaging with the liner.

Other objects and advantages of the present invention will become apparent from the drawings and description included herewith.

BRIEF DESCRIPTION OF THE DRAWINGS

FIG. 12 is a sectional view, partly in elevation, illustrating the operating string that is connected with the running tool of the present invention with a liner surrounding it and the running tool and operating string in turn positioned in a casing in a well bore;

FIG. 13 is a continuation of FIG. 12 and illustrates one form of a suitable means to inhibit premature actuation of the releasable connecting means that releasably connects the liner with the running tool member;

FIG. 14 is a sectional view on the liner 14—14 of FIG. 12 and illustrates in greater detail the configuration of the exterior surface of the running tool member and the releasable connecting means supported thereon for releasably connecting the running tool and operating string with the liner;

DESCRIPTION OF THE PREFERRED EMBODIMENTS

Attention is first directed to FIGS. 12–22 inclusive of the drawings. The apparatus of the present invention is represented generally by the letter A and is shown as being received within a casing C of a well bore. An operating string represented generally by the letters OS which extends from its connection with the running tool represented generally by the letters RT to the earth's surface whereby the running tool RT which forms part of the apparatus A may be manipulated to carry out the function of the apparatus within the well bore.

The running tool RT includes a member M having a longitudinal bore B extending therethrough. The apparatus A also includes the liner represented at L and the liner L is releasably connected to the running tool member M by the connection means referred to generally by the letters CM. In FIG. 13, one suitable form of inhibiting means represented generally by the letters IM are illustrated for inhibiting premature actuation of the connection means CM which would effect premature release of the running tool RT from the liner L.

Figure 15:
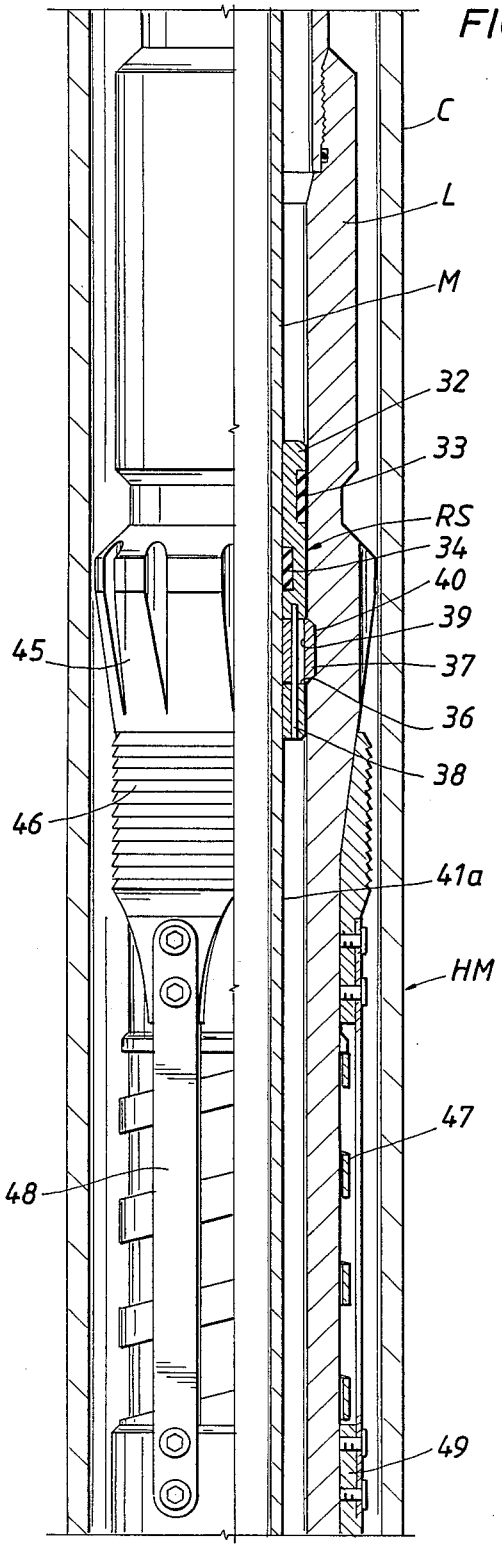
FIG. 15 is a continuation of FIG. 13 and illustrative a retrievable seal means for sealing between the running tool member and the liner as well as a form of the hanger means that may be employed for securing the liner to the casing in the well bore.

In FIG. 15 retrievable seal means represented generally by the letters RS, are provided between the member M of the running tool RT and the liner L for sealing therebetween. Also, hanger means represented generally by the letters HM are shown in FIG. 15 and the upper end of FIG. 16 for securing the liner L to the casing C when desired.

Figure 17:
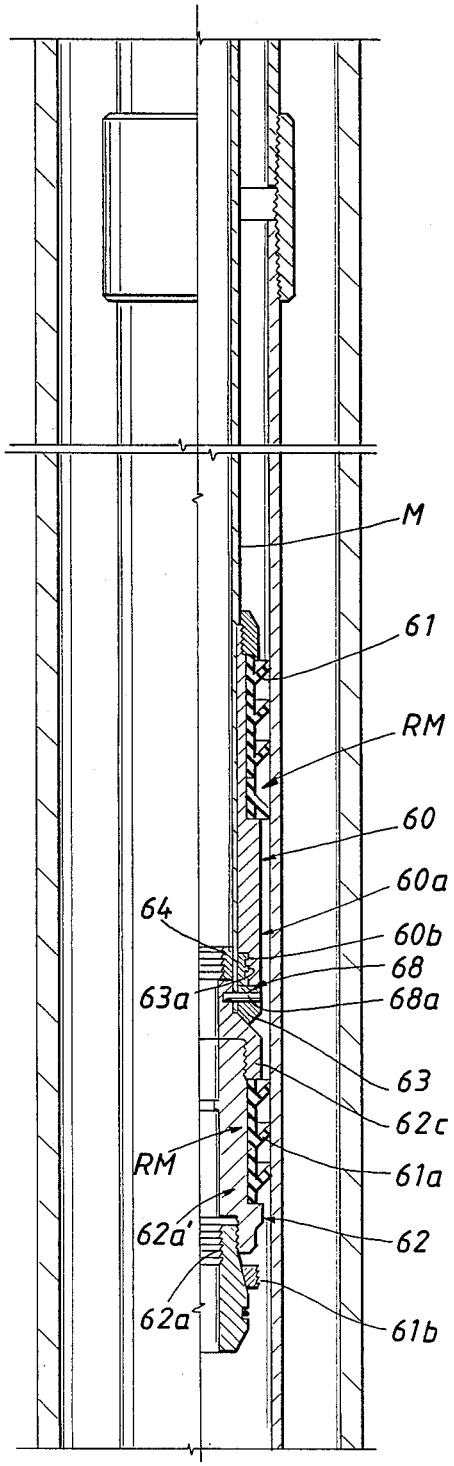
FIG. 17 is a continuation of FIG. 16 and illustrates the preferred arrangement and configuration of the hydraulically actuated seal means supported on the running tool member.

In FIG. 17 releasable seal means represented generally by the letters RM are illustrated as being supported on the member M of the retrievable tool for effecting a seal with the liner as they move therethrough as will be explained in greater detail.

Figure 18:
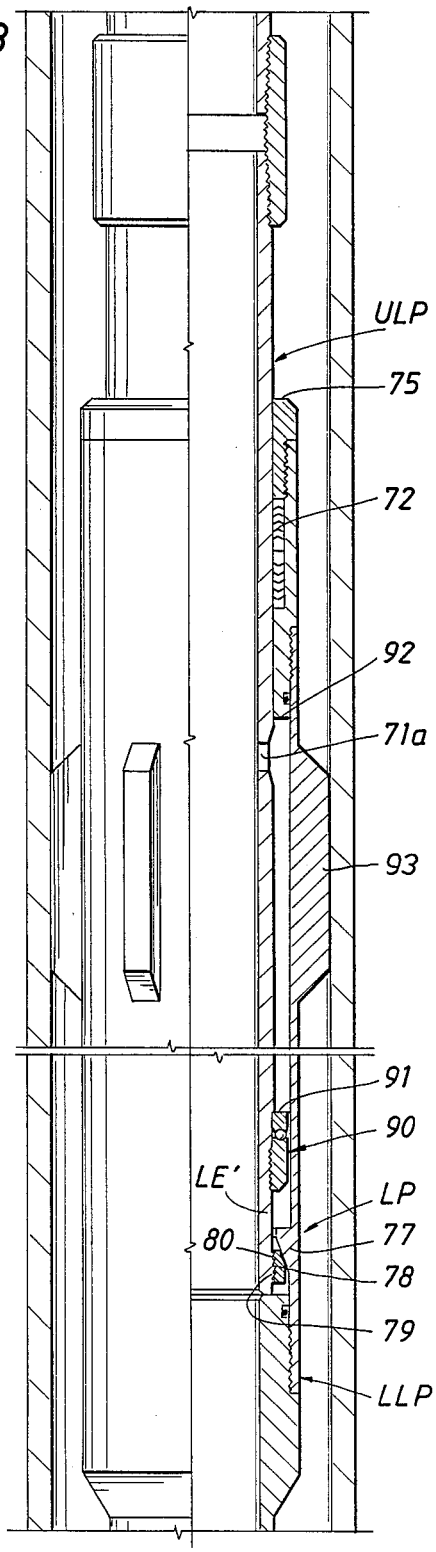
FIG. 18 is a continuation of FIG. 17 and illustrates the bearing means between the upper and lower liner portions for accommodating relative rotation therebetween as well as the releasable lock means that locks the upper and lower liner portions against relative longitudinal movement in either direction and premature actuation of the port means in the upper liner portion.
Figure 19:
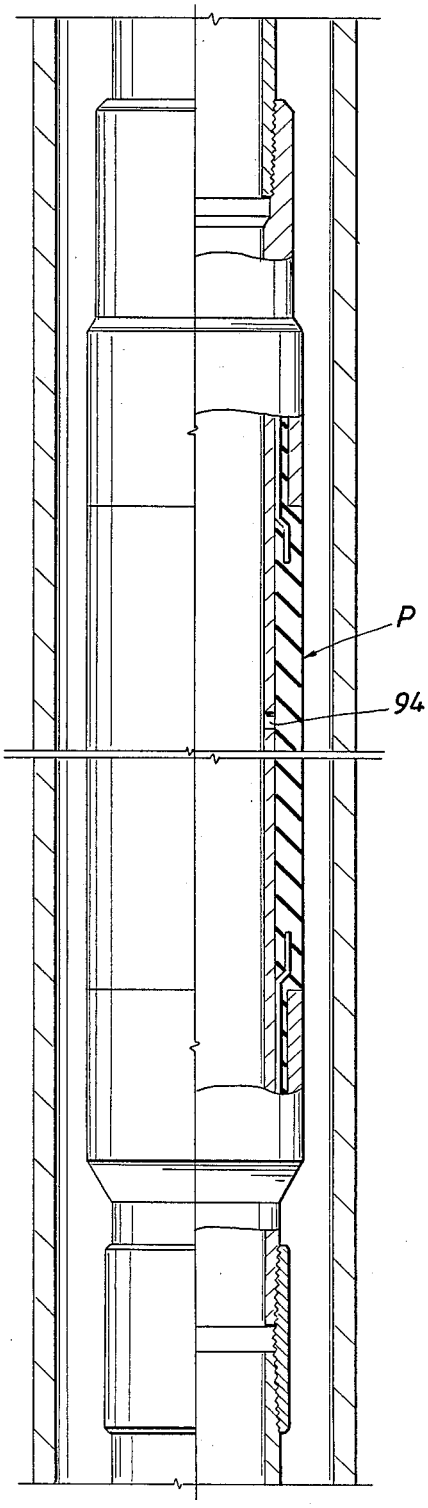
FIG. 19 is a continuation of FIG. 18 and illustrates the arrangement of the apparatus when a packer is employed with the lower limit portion.
Figure 20:
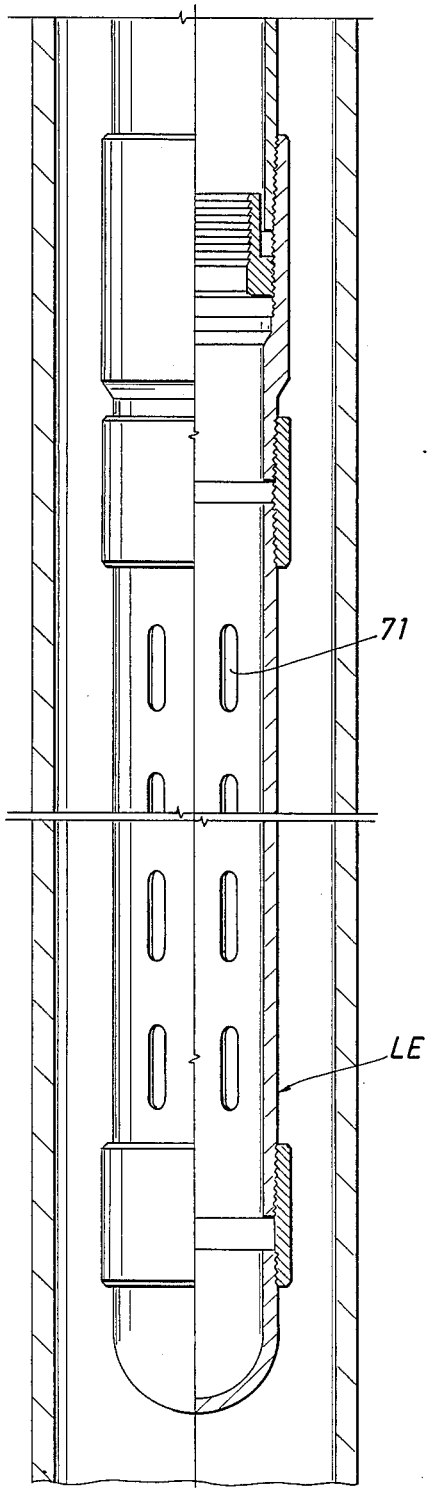
FIG. 20 is a continuation of FIG. 19 and illustrates the lower end of the lower liner portion with suitable flow ports or passages therein as well as the catcher means for catching the first plug and wiper means after it is moved through the liner.

In FIG. 18 the lower liner portion designated by the letters LLP is illustrated as extending upwardly from its lower end shown in FIG. 20 and designated generally by the letters LE. The lower liner portion LLP telescopically receives the upper liner portion referred to generally by the letters ULP as represented in FIG. 18 of the drawings. The upper liner portion of the liner can be considered as extending from its lower end LE' that is in locked position with the upper end portion of the lower liner portion as represented in FIG. 18 by the letters LP. The upper liner portion extends upwardly and surrounds the running tool member M as shown in FIGS. 12–18. It terminates at its upper end represented generally by the letters UE in FIG. 12 of the drawings.

Where a packer represented generally by the letter P in FIG. 19 is to be employed, it will be positioned on the lower liner portion LLP as shown in FIGS. 1–7 and FIG. 19. Such packer P is ordinarily of the inflatable type so that it can be inflated to sealingly engage with the well bore wall and secure the lower liner portion in position in the well bore.

Referring once again to FIG. 12 suitable means to maintain the connecting means CM disengaged from the liner L after it has been released from the liner is represented by the letters MM in FIG. 12.

The operating string OS of course, is provided with a fluid passage internally thereof which communicates with the internal bore B of the running tool member M. The maintaining means MM includes an annular housing 20 which extends longitudinally of and in radially spaced relation as represented at 21 relative to the outer surface of the running tool member M. The housing 20 is an extension of the collar 19 which collar is threadedly engaged with the bearing support member 18. Suitable bearing means as illustrated at 17 are supported on the bearing support means 18 and engage the adjacent downwardly facing surface 16 formed on the member M. Thus, the running tool member M is freely relative to bearing support 18 and housing 21.

Formed internally of collar 19 is longitudinally extending annular tapered surface **19*a* on which rests a segmented nut 19*b*, the segments of which are supported for resilient expansion and contraction by means of the spring 19*c* engaged therearound. It will be noted that the longitudinal extent of the tapered portion 19*a* and the space within 19 receiving the segmented nut 19*b* is of greater longitudinal; extent than the longitudinal extent of the segmented nut 19*b* so that it may move longitudinally within collar 19** and thereby expand as it is engaged with the connecting means CM to secure the connecting means CM therewith and inhibit reconnection of the connecting means with the liner L during operation as will be explained.

It will be noted that the connecting means CM includes surface means which are illustrated as being in the form of threads 25 configured so as to lockingly engage with the segmented nut **19*b*** as will be explained.

The releasable connecting means CM includes threaded nut means 26, with the upper extended end of threaded nut means having provided thereon the surface means 25 above referred to. The threaded nut means is supported on a longitudinally extending, noncircular portion 27 of the running tool member M as represented in FIGS. 12 and 14. Thus, the running tool member M may be moved longitudinally relative to the nut 26, but the nut 26 is co-rotatable with the member M for disconnecting from the liner L when the running tool member M is rotated as will be explained.

The inhibiting means IM which is provided to inhibit premature disconnection of the threaded nut 26 from the liner L may be of any suitable form such as in the form of a shear pin which connects the threaded nut with the running tool member M, or it may in the form of groove means 29 formed in the upper liner portion and spring urged dog means 30 supported on the running tool member M as shown in FIG. 13.

When the apparatus A is assembled for lowering into the well bore, the components thereof will assume the relationship illustrated in FIGS. 12–20 respectively and in such relationship the running tool RT is connected by its member M with the liner L through the nut 26. Thus, the entire apparatus A comprising the running tool RT and liner L may be rotated and reciprocated by the operating string OS when the lower liner portion is being cemented in the well bore as explained with regard to FIGS. 6–11. Such rotation and reciprocation can be effected without causing relative longitudinal movement between the upper and lower liner portions which movement might, with prior art known to applicants otherwise open the port means in the upper liner portion prematurely and improperly discharge cement into the well bore in a undesired sequence.

The retrievable seal means RS illustrated in FIG. 15 includes an annular seal bushing body 32 which is provided with seal means 33 and 34 on its inner and outer annular surfaces. The seal bushing body 32 is of suitable size to fit between the running member M and the liner L as shown in the drawings. It also includes windows or circumferentially spaced apertures 36 in which are mounted radially movable dogs 37. The dogs are supported in each window by suitable means such as the pin 38 which fits in the slot 39 extending longitudinally through each dog, with the width or diameter of the pin being less than the width of the slot, as shown, to accommodate extension of the dogs to seat in the annular groove or profile 40 of the liner and shown in FIG. 15, and retraction to retract them therefrom when the reduced diameter portion 41 of the running tool member M is positioned there adjacent. The seal is maintained in position shown in FIG. 15 by reason of the annular outer surface 41a on the member M which fits closely adjacent the inner annular surface of the dogs 37 when in extended position as shown in FIG. 15. To retrieve the seal means, the operating string OS and running tool RT are elevated to position the seal bushing housing 32 adjacent the smaller diameter portion 41 of the member M shown in FIG. 16 to accommodate withdrawal of the dogs 37 from the groove 40 in the liner whereby the seal means RS can be retrieved from the well bore with the operating string and running tool RS at the conclusion of operations.

Figure 16:
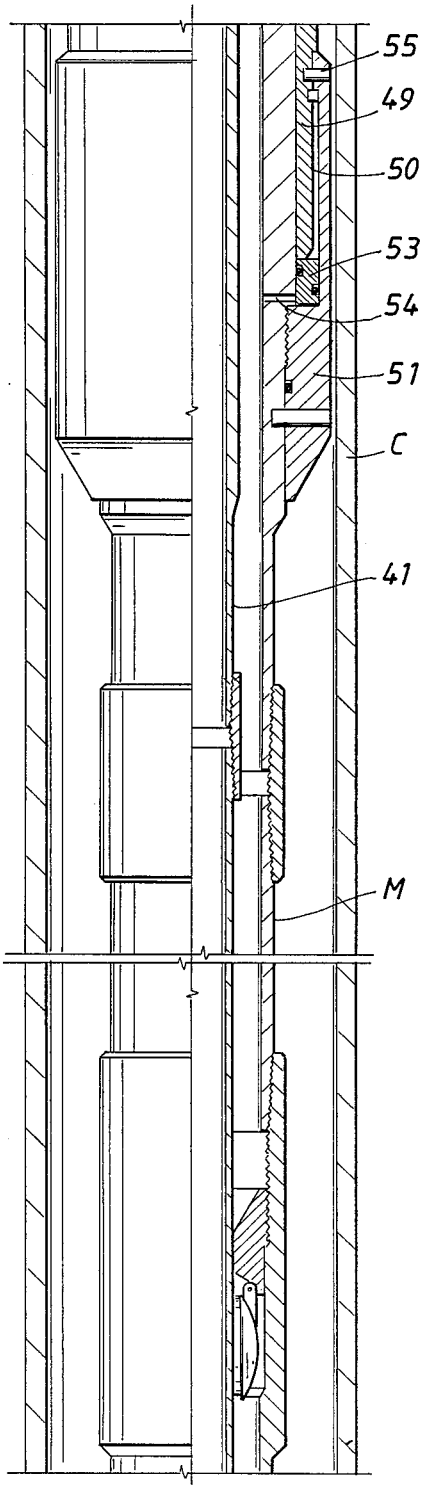
FIG. 16 is a continuation of FIG. 15 and illustrates further details of the hanger means.

FIG. 15 and 16 also show hydraulically actuated hanger means HM for securing the liner to the casing C. This includes the conical segments 45 on the liner which are adapted to receive the slip segments 46 when the slip segments 46 are moved upwardly. The hanger means includes spring means 47 to aid in retaining the slip segments disengaged from the conical segments 46 during lowering operations in the well bore. The slip segments are supported on the longitudinally extending members 48 which members are in turn connected to the annular member 49 as shown in FIG. 15. The lower end of annular member 49 is received in the longitudinally extending annular recess 50 formed in the collar 51 threadedly secured on the member M as shown in FIG. 16. Suitable piston means 53 are provided with seals as shown for sealably engaging in the longitudinally extending recess 50 beneath the lower end of the annular member 49, and suitable port means 54 are provided in collar 51 for communicating fluid from the operating string to act on the piston 53 when it is desired to engage the hanger means with the casing to secure the liner thereon. When the pressure exceeds the pressure required to shear the sehar pin 55, the member 49 will move upwardly thereby moving the slip segments 46 onto the conical surface 45 and secure the liner L to the casing C.

The releasable seal means RM carried by the member M includes second liner wiper means 60 having an annular body designated generally at **60*a* on which are provided longitudinally spaced annular seals 61 that sealably engage the liner L as shown. First releasable wiper means 62 includes the annular body 62*a*' having longitudinally spaced seal means 61*a*** thereon that sealably engage liner L, as shown.

It will be noted that the running tool member M extends substantially completely through the bore of the second wiper means 60 as shown in the drawings.

The lower end portion of the member M is slotted longitudinally at circumferentially spaced positions whereby the end cap member 63 of body 60 is threadedly engaged by threads **63*a* thereon and with the second wiper annular body 60*a*. Thus body 60*a* of second wiper means 60 extends through such slots into the bore of the member M. The end cap 63 includes the portions 64 that extend through the longitudinal slots in the member M and projects inwardly into the bore of the body M. The portions 64 which are circumferentially spaced to fit through the circumferentially spaced slots in member M are threaded as illustrated to provide a means for receiving the second plug means 65 and secure such second plug means 65 with the second wiper means body 62 to enable them to sealingly move through the liner as a unit. The second plug means 65 includes annular seals 65*b* which seal with the operating string and running tool as it moves therethrough to sealably land in second wiper means 60. The second wiper means 62 is secured to the member M by means of the shear pin 68 adjacent the lower end of the member M as shown in FIG. 17, and is specifically secured by the shear pin portion 68*a* extending through end cap 63 and the portion of 68*a*** extending through member M between the slots in its end portion.

As noted previously, the member M extends through the second wiper means 60 and terminates in overlapping relation with the first wiper means 62 as shown in FIG. 17. This enables the first wiper means to be releasably secured in the bore of the running tool member M on the shear pin 68 and more specifically by that portion of shear pin 68 extending through member M and through end cap **62*c*. Thus, the first and second liner wiper means 60 and 62 are secured to the running tool member M in substantially the same circumferential position and at substantially the same transverse position with respect to the running tool member. If desired, the first wiper means 60** could be further secured to the running tool member M at additional circumferentially spaced positions and at substantially the same transverse positions with respect to the running tool at which aid second wiper means is secured to the running tool to more positively assure that a different hydraulic pressure will be required to release the first wiper means from that required to release the second wiper means.

Further, the second wiper means 62, if desired, could be secured to the member M at its upper end. In this situation, the portion of the shear pin 68 extending through the member 63 forming the lower end of the upper wiper means would be eliminated so that such shear pin 68 would extend only through the first wiper means upper end as shown and the surrounding member M as above described.

Heretofore, substantial difficulty has sometimes been encountered where tandem wiper means or tandem wiper plugs have been employed in cementing operations because the first wiper means has, so far as known to applicant, been secured to an operating string or a running tool member M above the smallest internal diameter of the second wiper means 60. This may cause the first wiper means to hang up or malfunction when it is released so that the entire cementing operation is adversely affected. In the present invention this is overcome because the first wiper means is secured in the internal bore of the second wiper means and in the internal bore of the member M below the smallest internal diameter of the second wiper means and member M.

It will be noted that the first wiper means 62 is provided with a suitable configured surface **62*a* for sealingly and lockingly receiving therein a first plug means 65*c* as illustrated in the drawings. The first plug means includes annular seals 65d** for sealing with the first wiper means bore.

The lower liner portion may communicate with the well bore by any suitable configured port or passage means such as represented at 71 in FIG. 20. The upper liner portion is provided with port means **71*a*** as shown in the drawings.

As noted previously, the upper liner portions and lower liner portions are telescopically arranged as illustrated in FIG. 18 with the upper liner portion being telescopically received within the lower liner portion. Suitable seal means as represented at 72 are provided for sealing therebetween to inhibit communication through the port means 71*a* in the upper liner portion until the port means 71*a* is exposed to the well bore above the termination 75 of the lower liner portion.

When the lower and upper liner portions are in the relationship illustrated in FIG. 18, no relative longitudinal movement may occur therebetween in either direction, although they may be rotated simultaneously by reason of the groove and dog arrangement 29 and 30 described previously with regard to FIG. 13.

Although any suitable means may be employed to lock the lower liner wiper portion and upper liner portion against relative longitudinal movement, it is desired that such arrangement be maintained in its simplest form.

To this end it will be noted that in FIG. 18 the lower liner wiper portion is provided with an annular tapered inwardly projecting portion 77 adjacent the lower of the upper liner portion. Positioned between such inward projection 77 and the lower end of the upper liner portion is a segmented nut 78 which is of shorter longitudinal extent than the longitudinal extent defined by the inwardly tapered portion 77 so that the segmented nut 78 may fully move longitudinally a limited extent between the upper and lower liner portions when desired. The nut 78 is provided with suitable threaded surface 79 for engaging with the threaded surface 80 on the lower end of the upper liner portion so that the upper liner portion engages with the segmented nut as shown in FIG. 18 to lock the lower and upper liner portions against relative longitudinal movement. A spring on nut 80 urges the segments of the nut 78 together, but accommodates radial expansion.

When it is desired to release the upper and lower liner portions for relative longitudinal movement, the operating string is rotated and since it through the running tool is connected to the liner, the upper liner portion rotates when the lower liner portion is restrained by the packer P or cement so that the threaded engagement 79 and 80 may be disengaged to release the upper liner portion for relative longitudinal movement by lifting on the operating string and running tool.

Mounted above the inwardly projecting portions 77 and between the lower and upper liner portions are suitable bearing race means referred to generally at 90 and the bearing race is provided with a shoulder 91 which, when engaged with the shoulder 92, accommodates relative rotation between the disconnected, but telescoped upper and lower liner wiper portions.

If desired, suitable spacers or stabilizers represented at 93 as shown in FIG. 18 may be provided on the lower liner portion to assist in centralizing the liner in a casing in a well bore.

The packer means P may be of any suitable inflatable type and secured on the lower liner portion in any suitable well known manner. Intermediate its ends there is formed a port means 94 in the lower liner portion, and such port may include a one-way acting check valve represented at 95' when desired.

Operation of the Apparatus

Attention is again directed to FIGS. 1–5 of the drawings wherein in FIG. 1, the apparatus is shown as lowered into position in the well bore WB to the desired depth. While the well bore is shown as vertical, as previously mentioned the present invention has particular utility in connection with highly deviated holes including holes that are horizontal or substantially horizontal.

Figure 1:
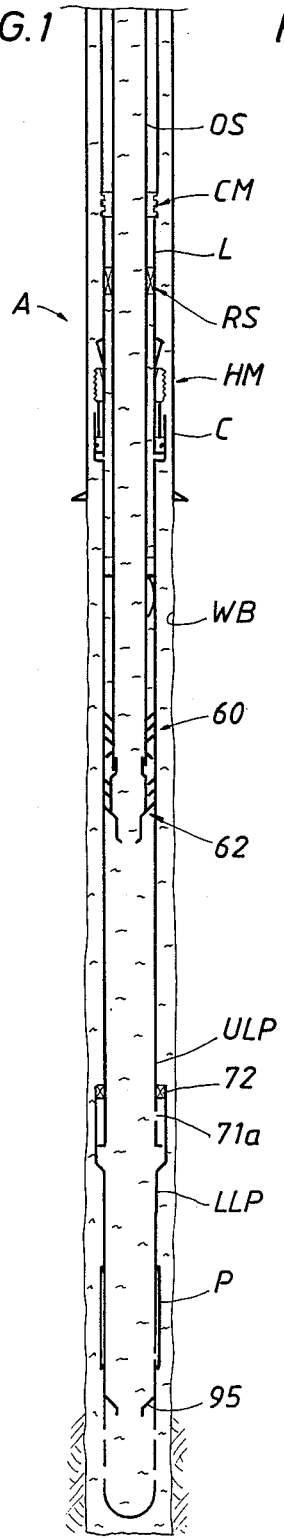
FIG. 1 is a diagrammatic view illustrating the apparatus of the present invention in a well bore having a casing.
Figure 2:
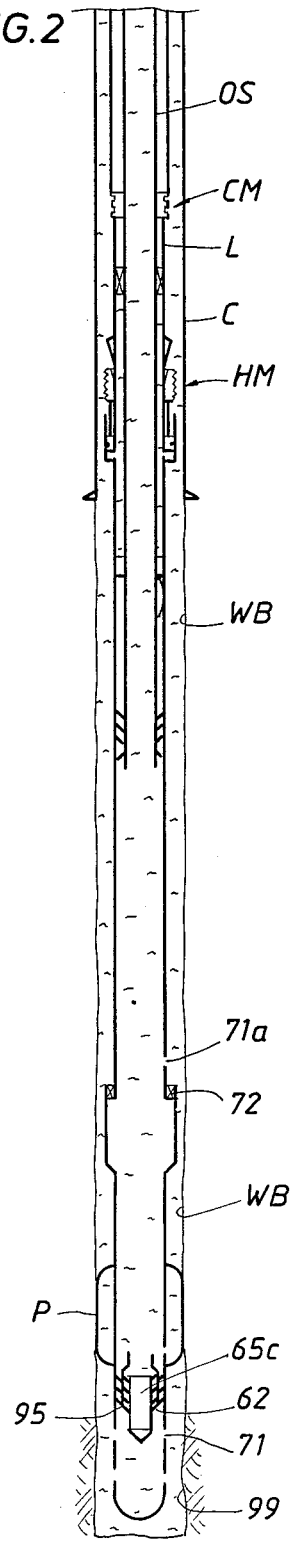
FIG. 2 is similar to FIG. 1 but it illustrates the port means in the lower liner portion closed off and the packer inflated.
Figure 3:
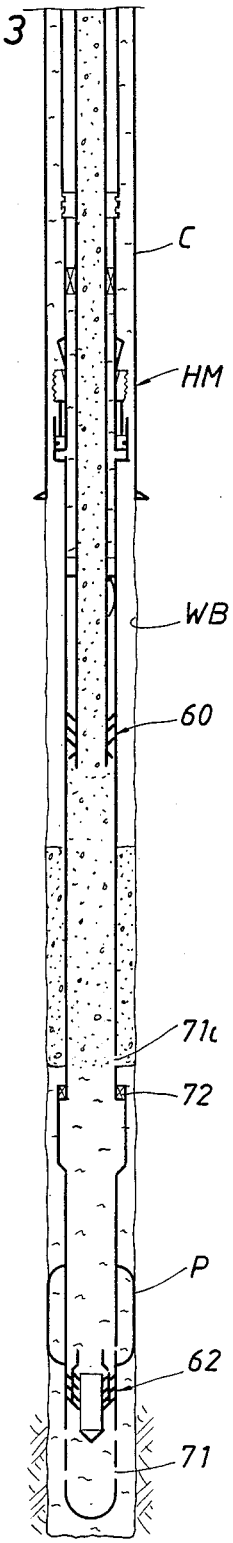
FIG. 3 is a view similar to FIG. 2 and illustrates the port means in the upper liner portion open for discharge of cement therethrough into the well bore.
Figure 4:
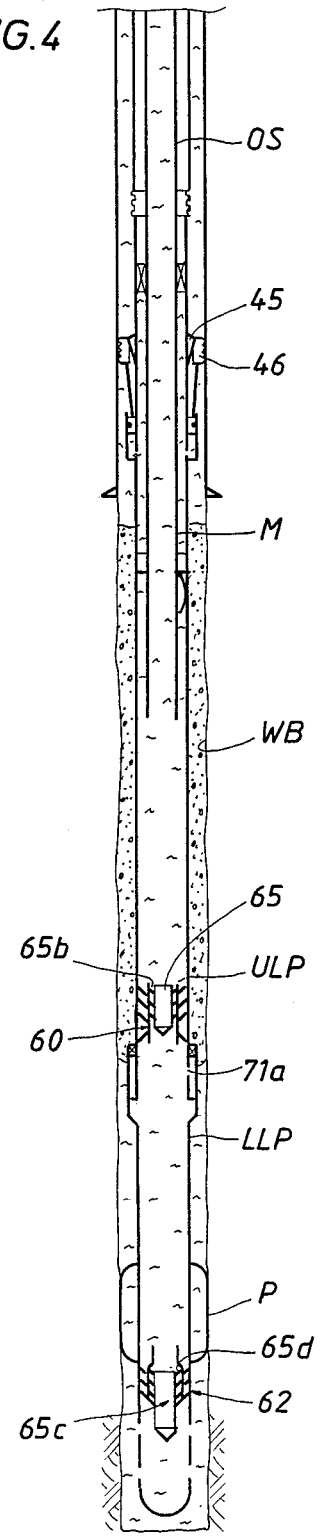
FIG. 4 is a view similar to FIG. 3 and illustrates the operating string and running tool connected therewith manipulated to close the port means in the upper liner portion and the hanger means actuated to secure the liner to the casing in the well bore.

After the apparatus is positioned as shown in FIG. 1, the first plug 65*c* is dropped into and sealingly engages within the operating string so that it may be pumped down the operating string and pumped into position so that its threaded surface latches with the surface 62*a* of the first wiper means 62. Thereupon, increased pressure in the operating string shears the portion of the shear pin 68 which connects the first wiper means 62 to the member M, as previously described, and it along with the plug 65*c* moves downwardly through the liner. The seals 61*a* sealingly and movingly engage the liner as the first wiper and plug move therethrough and the configured surface 61*b* on the first wiper means engages and latches in suitable catcher means 95 which has a surface formed that engages and latches with the surface 61*b* on the first plug means. This secures the first plug and wiper means in the position shown in FIG. 2 of the drawings so that the passage means 71 formed in the lower liner portion is blocked off. Further, the portion of the well bore formation represented at 99 is sealed off from communication with the portion of the well bore WB above the packer P as shown in FIG. 2. In some circumstances it is found that the hydrocarbon producing formations may be so compact or consolidated that it is difficult to obtain the desired flow therefrom and in such circumstances it may not be desirable to cement adjacent such formations. Thus, it will be noted that only well bore fluid is in the portion of the well bore 99 beneath the packer P when it is expanded to seal against the well bore wall as illustrated in FIG. 2 of the drawings. After the lower liner portion has thus been secured in the well bore at the desired elevation, the upper liner portion may be manipulated by the operating string and connected running tool to rotate it to disengage the threaded surface portion 80 on the upper liner portion from the segmented nut 78. When this is accomplished the upper liner portion may be lifted to position the port means 71*a* therein above the seal means 72 for communication with the well bore for discharging cement through the port means 71 in the upper liner portion into the well bore WB as shown in FIG. 4.

Normally, a second plug 65 is then pumped down the operating string behind the slug of cement and through the member M and it also is provided with seals to sealingly engage with the bore of the operating string running tool member M and is provided with a threaded surface to latch with the surface 64 of the second wiper means 60. The surface 64 in the upper wiper means engages the conforming surfaces on the second plug means 65 to lock them together and this blocks flow through the operating string so that hydraulic pressure shears the balance of the shear pin 68 in the form illustrated in FIG. 17 of the drawings. Second plug 65 and second wiper are sealed together and sealingly move through and engage the liner as a unit as they move therethrough to the position represented in FIG. 4.

It can be appreciated that the volume of cement to be discharged into the well bore is calculated so that the second plug and wiper will assume a position adjacent the port means 71*a* when the proper volume has been communicated to the well bore. Further, it will be noted that the fluid present in the lower liner portion between the second plug and wiper and the first plug and wiper as represented in FIG. 4 will also assist in properly positioning the second plug 65 and wiper therein.

After this has been accomplished, the relesable lock means LP can be actuated to again secure the upper and lower liner portion against relative longitudinal movement by lowering the operating string and running tool until the upper liner portion threaded surface 80 engages with the threads 79 on the resilient spring loaded nut 78. The nut 78 will expand as the upper liner portion moves thereinto and will enable the threads 79 and 80 to engage.

Figure 5:
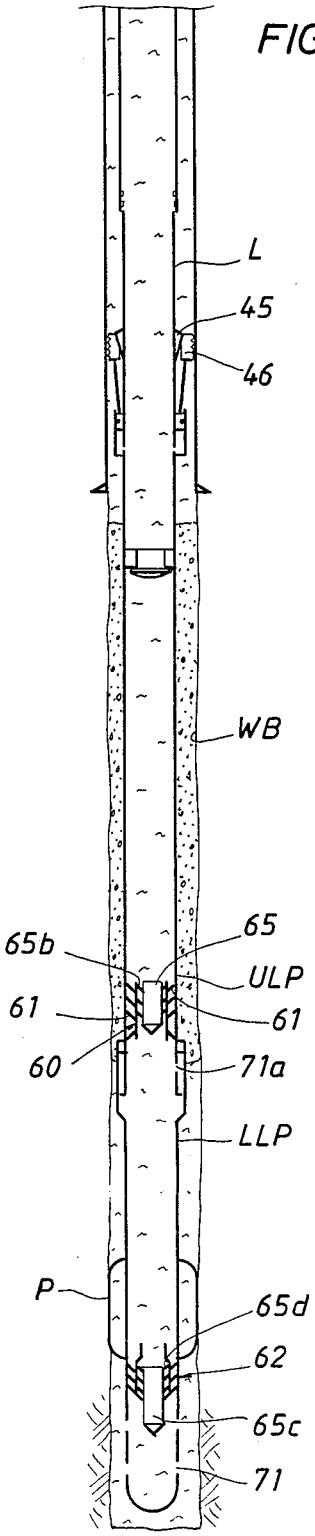
FIG. 5 is a view similar to FIG. 4 but illustrates the connecting means between the liner and running tool having been actuated to release the running tool and retrieved from the well bore.
Figure 6:
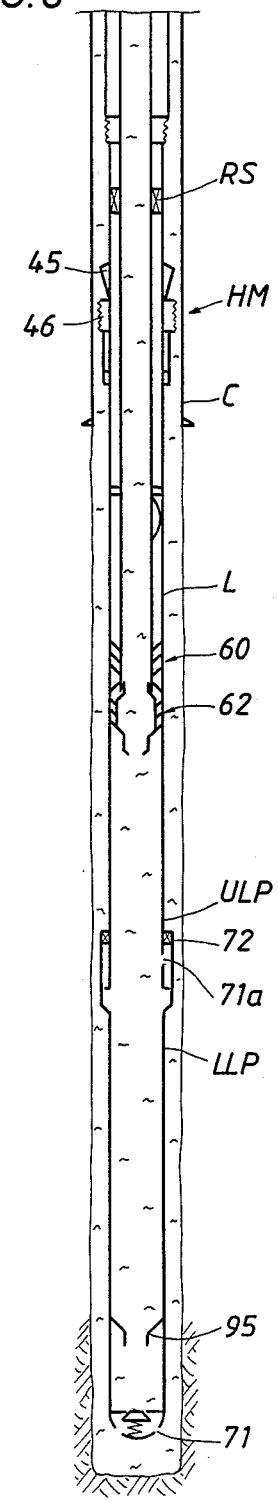
FIG. 6 is a schematic view similar to FIG. 1 showing the apparatus of the present invention in the well bore without a packer.

After this operation has been completed, the hanger means HM may be actuated to move the slip segments 46 up on the conical surfaces 45 as represented in FIGS. 4 and 5 of the drawings. Fluid pressure through the port 54 is communicated to the piston 53 which moves the lower end of 49 upwardly in the recess 50 to shear the pin 55 thereby moving the slip segments 46 up on the conical surface 45 outwardly into engagement with the inner surface of the casing.

After this has been accomplished, the operating string and running tool may then be released from the liner by rotation in a right-hand direction to release the threaded nut 26. After the nut has been released, the operating string and running tool member M are lowered so that the threaded surface 25 on the nut 26 may engage and lock with the segmented nut 19*b* and thereby maintain the threaded nut 26 disengaged from the liner. As previously noted, in some circumstances the pipe may corkscrew or wind up or other pipe movement may cause the nut 26 to be automatically reengaged with the liner unless it is maintained in a position so as to not be adjacent the threads 26*a* on the liner with which it is normally connected during the operation of the apparatus as described hereinabove. When the running tool member is lowered, the lower end 20*c* of the member 20*a* can abut the upper end 26*b* of the liner and rotation of the member M can still be effected since the bearing means 17 permits 20 to remain stationary while the member M is rotated.

Apparatus A of the present invention can be employed in the two stage cementing method and procedure illustrated in FIGS. 6–11. It includes the components previously described and identified herein and again represented generally in the schematic drawings.

In FIG. 6 the apparatus A is again positioned in the well bore with the upper and lower liner portions connected together against relative longitudinal movement as previously described.

Figure 7:
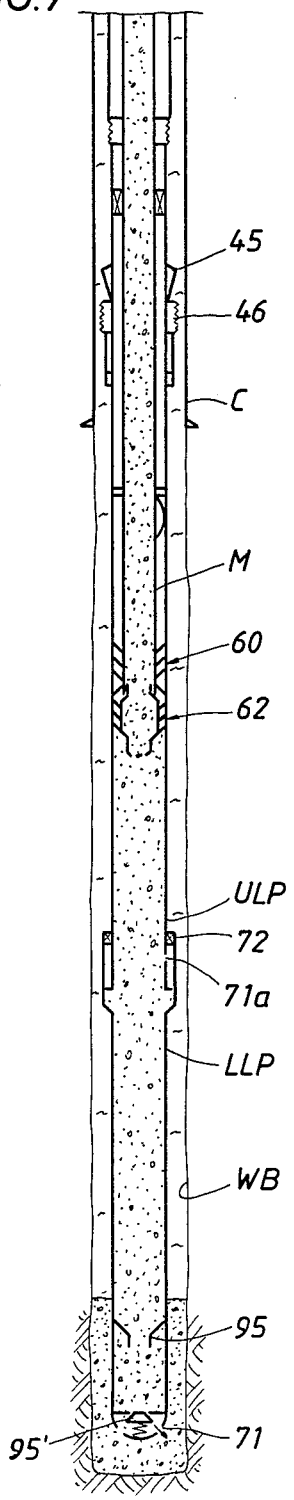
FIG. 7 is a view similar to FIG. 6 and illustrating the flow of cement through the operating string, running tool and liner to be discharged through the port means in the lower liner portion into the well bore.
Figure 8:
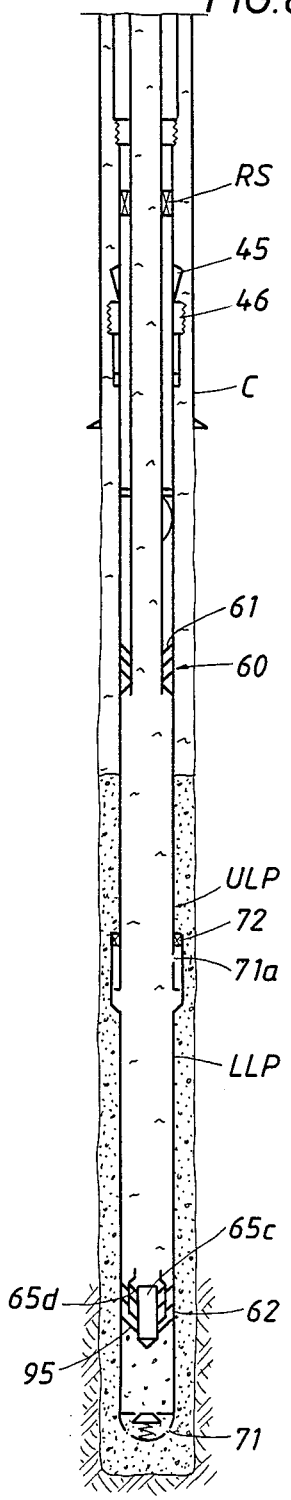
FIG. 8 is a view illustrating the first plug and wiper means engaged and having sealably moved through the liner behind the cement to the position represented and engaged with the catcher in the liner.
Figure 9:
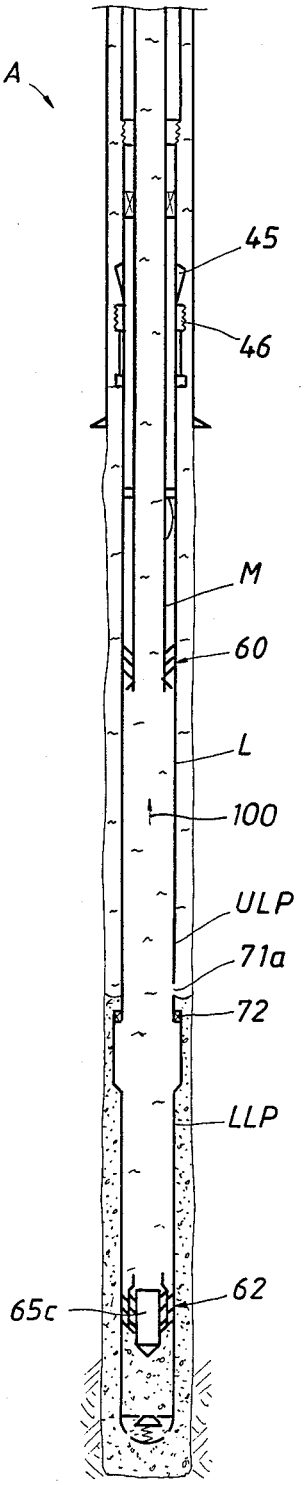
FIG. 9 is a schematic view illustrating the operating string and running tool having been manipulated to open the port means in the upper liner portion and illustrating the path of well bore fluid being reverse circulated through the upper liner portion port means for displacing excess cement from the well bore adjacent the port means.
Figure 10:
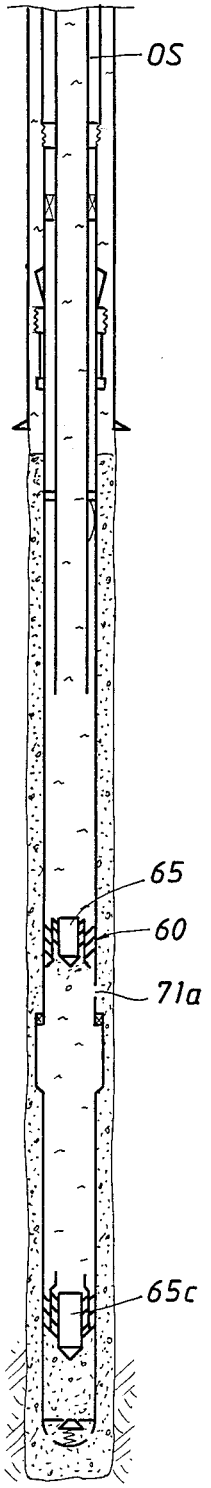
FIG. 10 is a schematic view illustrating the second plug and wiper means having been moved through the liner to a position adjacent the port means in the upper liner portion.
Figure 11:
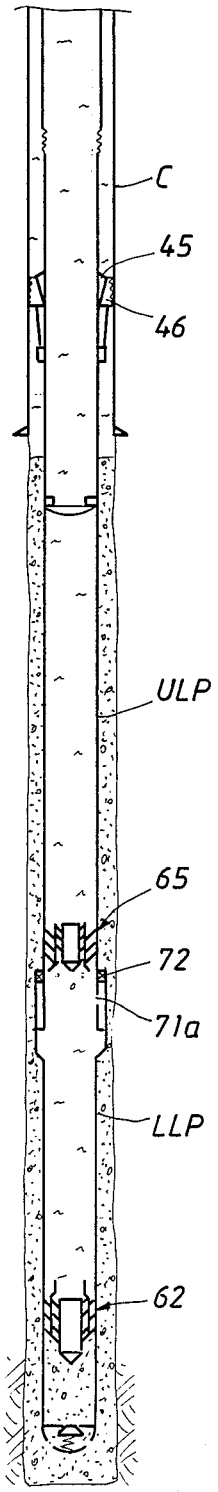
FIG. 11 is a schematic view illustrating the operating string and running tool having been manipulated to disengage from the liner that has been hung on the well bore and having been retrieved from the well bore.

In FIG. 7 cement is illustrated as being discharged down through the operating string, running tool member and the liner L to be discharged through the port means 71 in the lower liner portion into the well bore WB. A first plug 65*c* is positioned in the operating string at the end or on top of the cement slug therein and is pumped downwardly behind the cement so that it engages with the first liner wiper 62 as described with regard to FIGS. 1–5. The cement is continued to be pumped and discharged through the port means 71 in the lower liner portion and displaces well bore fluid therein. Since the correct volume of cement is known, when the first plug and wiper reach the catcher means 95 as shown in FIG. 8, the correct volume desired in the well bore between the well bore wall and the lower liner portion will be present. In some instances, the amount of cement pumped into the well bore between it and the liner will rise above the location of the port means in the upper liner portion. The port means 71*a* in the upper liner portion is opened in a manner as previously described by rotating the upper liner portion to disengage and unlock it from the lower limit portion so that it may be lifted to expose the port 71*a* in the upper liner portion to the well bore above the seal means 72 between the upper and lower liner portions. Thereupon reverse circulation downwardly through the well bore and back into the liner through the port means 71*a* in the upper liner portion may be effected so that the excess cement in the well bore from the first stage is washed back into the operating string and circulated to the well bore. This flow is represented by the arrows 100 in FIG. 9.

When the desired circulation has been effected, a second volume of cement is placed in the operating string and a second plug 65 is placed on top of it or behind it so that it is pumped down the operating string, through the member M of the operating tool and the plug 65 engages with the second wiper 60 in a manner as previously described with regard to the FIGS. 1–5 modification. Thereupon the plug and liner wiper seal move simultaneously through the liner to sealingly engage therewith. The plug and the wiper reach the position adjacent the port means in the upper liner shown in FIG. 10, since the volume of cement to be discharged is known and fluid in the lower liner portion beneath the second plug and seal help to position such plug and wiper. When the second plug and wiper reach the position represented in FIG. 10, the operating string and running tool member can be lowered so that the lower and upper liner portions relatch against relative longitudinal movement to prevent reopening of the upper port means.

Figure 21:
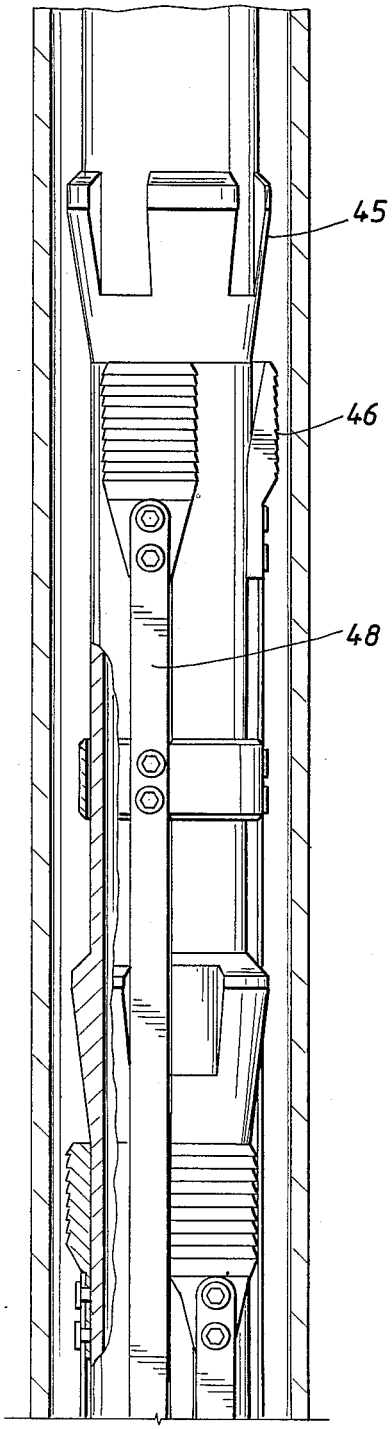
FIGS. 21 and 22 are sectional views illustrating a mechanical hanger arrangement which may be employed in lieu of the hydraulically actuated hanger means shown in FIGS. 15 and 16.
Figure 22:
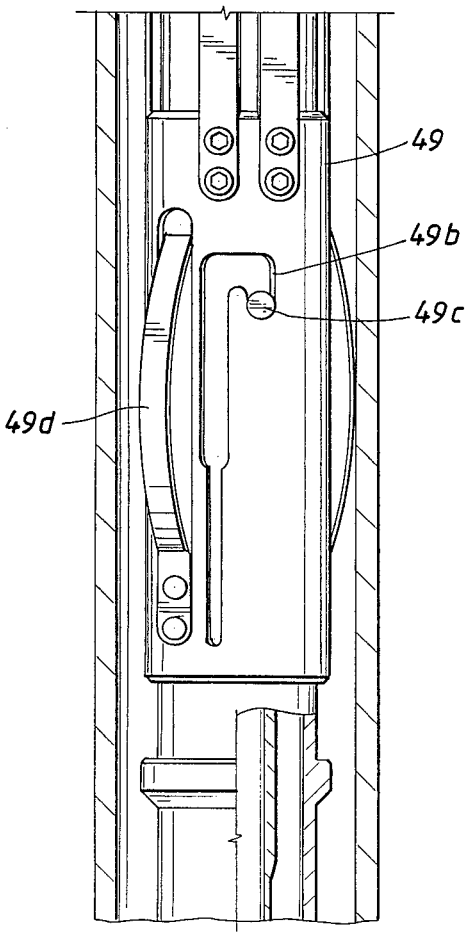

Thereafter the hanger means HM can be actuated as previously described to expand the slips 46 upwardly and outwardly on the conical surfaces to secure or hang the liner in the casing C.

Where it is desired to employ a mechanical hanger in lieu of a hydraulic hanger, the arrangement illustrated in FIGS. 21 and 22 can be employed. It will be noted that the slip segments 46 and conical surfaces 45 are of the same general configuration with the slip segments 46 being secured on the elongated members 48 that are in turn carried by a sleeve member 49. The sleeve member 49 is provided with a J-slot 49*b* as shown and a pin 49*c* is provided on the member M. Bow springs 49*d* are also carried on the sleeve member 49, and when it is desired to set the slips, the pin 49*c* may be moved from its position into the longitudinal portion 49*e* of the J-slot by lifting the operating string and then lowering it. The bow springs 49*d* restrain movement of the sleeve member 49 relative to the member M by their frictionally engaging the inner wall of the casing. This enables the slip segments 46 to be moved into position on the cone segments 46 and hang the liner portions in the casing.

After the liner portions are relocked which closes port means 71*a*, the running tool is rotated by the operating string to disengage from the liner and remove from the well bore.

The foregoing disclosure and description of the invention are illustrative and explanatory thereof, and various changes in size, shape and materials as well as in the details of the illustrated construction may be made without departing from the spirit of the invention.

What is claimed is:

1. Apparatus for stage cementing a liner in a well bore having a casing comprising:

a liner;
a running tool including:
a member having a longitudinal bore therethrough;
releasable connecting means for releasably connecting said running tool member to the liner;
inhibiting means to inhibit premature actuation of said releasable connecting means;
retrievable seal means sealing between said running tool member and said liner to accommodate axial movement of said running tool member relative to the liner while avoiding communication between the inside and outside of the liner throughout the length of the liner below said retrievable seal means and above where cement is discharged from the liner into the well bore;
said liner having longitudinally aligned, telescopically arranged upper and lower liner portions with seal means therebetween and port means in each of said portions for communicating the interior of the liner with the well bore; and
releasable lock means to lock said liner portions against relative longitudinal movement and thereby avoid premature communication through the port means in said upper liner portion, said releasable lock means responsive to relative movement between said liner portions to release for accommodating relative longitudinal movement between said portions whereby the port means in said upper liner portion may communicating with the well bore for discharge of the cement from the liner to the well bore.

2. The apparatus of claim 1 including bearing means between said liner portions to accommodate relative rotation therebetween.

3. The apparatus of claim 1 wherein said releasable lock means is responsive to relative rotation between said liner portions to release for accommodating relative longitudinal movement therebetween and is responsive to telescoping movement of said liner portions to reengage said releasable lock means.

4. The apparatus of claim 1 including packer means on one of said liner portions for sealably engaging the well bore.

5. The apparatus of claim 1 wherein the releasable connecting means includes threaded nut means on said running tool member connecting the running tool member to said liner and wherein said inhibiting means includes groove means in said liner and spring actuated lug means on said running tool member for engaging in said groove means to inhibit relative rotation between said liner and setting tool member and to accommodate corotation of said liner and running tool member.

6. The apparatus of claim 1 wherein the releasable connecting means includes threaded nut means on said running tool member and connecting the running tool member to said liner, said threaded nut means disconnectable from said liner upon relative rotation between said running tool member and liner, segmented nut means supported on said running tool member and longitudinally spaced relative to said threaded nut means, said threaded nut means having surface means engageable with said segmented nut means upon disengagement of said threaded nut means from said liner and when said running tool member is moved longitudinally relative to said liner to thereby inhibit reengagement of said threaded nut means with said liner.

7. The apparatus of claim 1 including tandem liner wiper plugs on said running tool member.

8. The apparatus of claim 1 wherein said hanger means is hydraulically actuated by fluid pressure in the liner.

9. The apparatus of claim 1 wherein said hanger means is mechanically actuated by manipulation of said running tool member relative to the liner.

10. Apparatus for cementing a liner in a well bore having a casing comprising:
a liner;
a running tool including:
a member having a longitudinal bore therethrough;
releasable connecting means for releasably connecting said running tool member to the liner;
inhibiting means to inhibit premature actuation of said releasable connecting means;
retrievable seal means sealing between said running tool member and said liner to accommodate axial movement of said running tool member relative to the liner while avoiding communication between the inside and outside of the liner throughout the length of the liner below said retrievable seal means and above where cement is discharged form the liner into the well bore;
said liner having longitudinally aligned, telescopically arranged upper and lower liner portions with seal means therebetween and port means in each of said portions for communicating the interior of the liner with the well bore;
releasable lock means to lock said liner portions against relative longitudinal movement and thereby avoid premature communication through the port means in said upper liner portion, said releasable lock means responsive to relative movement between said liner portions to release for accommodating relative longitudinal movement between said portions whereby the port means in said upper liner portion may communicate with the well bore for discharge of the cement from the liner of the well bore; and
hydraulically actuated seal means supported by said running tool member for sealing with the liner.

11. The apparatus of claim 10 wherein said hydraulically actuated seal means includes:
first plug means for effecting a movable seal with said running tool as it moves therethrough;
first wiper means for effecting a movable seal with the liner as it moves therethrough, said first wiper means having means for sealably engaging said first lower plug means therein whereby said first plug and wiper means may be sealably moved through the liner to close off communication between the liner and well bore through the port means in the lower liner wiper portion;
second plug means for effecting a movable seal with said running tool as it moves therethrough;
second wiper means for effecting a movable seal with the liner as it moves therethrough, said second wiper means having means for sealably engaging said second plug means therein werheby said second plug and wiper means forms a movable seal with the liner behind the cement as it is discharged into the well bore; and
said second wiper means having a portion extending through the running tool and into the bore thereof to receive said second plug means for movement of said second wiepr and plug means together sealably through the liner.

12. The apparatus of claim 11 wherein said first and second wiper means are secured to the running tool member in substantially the same circumferential position and at substantially the same transverse position with respect to the running tool member.

13. The apparatus of claim 11 wherein said first and second wiper means are secured to the running tool in substantially the same circumferential position and at substantially the same transverse position with respect to the running tool member, and wherein said first wiper means is further secured to the running tool at additional circumferentially spaced positions and at substantially the same transverse positions with respect to the running tool at which said second wiper means is secured to the running tool.

14. The apparatus of claim 11 wherein said second wiper means is secured to said running tool member in longitudinally spaced relation to the position at which said first wiper means is secured thereto.

15. The apparatus of claim 11 including:

latch means for latching said first plug means with said first wiper means against premature separation as said engaged first plug and wiper means move through the liner; and means for catching said first wiper means in the liner after it is moved therethrough.

16. The apparatus of claim 10 wherein said hydraulically actuated seal means includes:

first plug means for effecting a movable seal with said running tool as it moves therethrough;

first wiper means for effecting a movable seal with the liner as it moves therethrough, said first wiper means having means for sealably engaging said first lower plug means therein whereby said first plug and wiper means may be sealably moved through the liner to close off communication between the liner and well bore through the port means in the lower liner wiper portion;

second plug means for effecting a movable seal with said running tool as it moves therethrough;

second wiper means for effecting a movable seal with the liner as it moves therethrough, said second wiper means having means for sealably engaging said second plug means therein whereby said second plug and wiper means forms a movable seal with the liner behind the cement as it is discharged into the well bore; and means for releasably securing said first wiper means to said running tool member wherein said running tool member extends through said second wiper means and terminates in overlapping relation with said first wiper means for releasably securing said first wiper means in the bore of said running tool member.

17. The apparatus of claim 16 wherein said first and second wiper means are secured to the running tool member in substantially the same circumferential position and at substantially the same transverse position with respect to the running tool member.

18. The apparatus of claim 16 wherein said first and second wiper means are secured to the running tool in substantially the same circumferential position and at substantially the same transverse position with respect to the running tool, and wherein said first wiper means is further secured to the running tool at additional circumferentially spaced positions and at substantially the same transverse positions with respect to the running tool at which said second wiper means is secured to the running tool.

19. The apparatus of claim 16 wherein said second wiper means is secured to said running tool member in longitudinally spaced relation to the position at which said first wiper means is secured thereto.

20. A running tool for stage cementing a liner which has upper and lower telescoping liner portions with port means therein and cooperating surface means to releasably lock the liner portions against relative longitudinal movment and thereby avoid premature communication with the well bore through the port means in the upper liner portion, said running tool comprising:

a member having a longitudinal bore therethrough;

releasable connecting means for releasably connecting said running tool member to the liner to manipulate and disengage the liner portion surface means and open the port means in the upper liner portion and also to reengage the liner portion surface means and lock the liner portions against relative longitudinal movement and close the port means in the upper liner portion;

inhibiting means to inhibit premature actuation of said releasably connecting means;

retrievable seal means sealing between said running tool member and the liner to accommodate axial movement of said running tool member relative to the liner while avoiding communication between the inside and outside of the liner throughout the length of the liner below said retrievable seal means and above where cement is discharged from the liner into the well bore;

said releasable connecting means including threaded nut means on said running tool member and connecting the running tool member to said liner, said threaded nut means disconnectable from said liner upon relative rotation between said running tool member and liner, segmented nut means supported on said running tool member and longitudinally spaced relative to said threaded nut means, said threaded nut means having surface means engageable with said segmented nut means upon disengagement of said threaded nut means from said liner and when said running tool member is moved longitudinally relative to said liner to thereby inhibit reengagement of said threaded nut means with said liner; and hydraulically actuated seal means supported by said running tool member for sealing with the liner.

21. The apparatus of claim 20 wherein the releasable connecting means includes threaded nut means on said running tool member connecting the running tool member to said liner and wherein said inhibiting means includes groove means in said liner and spring actuated lug means on said running tool member for engaging in said groove means to inhibit relative rotation between said liner and setting tool member and to accommodate corotation of said liner and running tool member.

22. The apparatus of claim 20 wherein the releasable connecting means includes threaded nut means on said running tool member and connecting the running tool member to said liner, said threaded nut means disconnectable from said liner upon relative rotation between said running tool member and liner, resiliently expandable segmented nut means supported on said running tool member and longitudinally spaced relative to said threaded nut means, said threaded nut means having threaded surface means engageable with said segmented nut means upon disengagement of said threaded nut means from said liner and when said running tool member is moved longitudinally relative to said liner to thereby inhibit reengagement of said threaded nut means with said liner.

23. The apparatus of claim 20 wherein said hydraulically actuated seal means includes:

first plug means for effecting a movable seal with said running tool as it moves therethrough;

first wiper means for effecting a movable seal with the liner as it moves therethrough, said first wiper means having means for sealably engaging said first plug means therein whereby said first plug and wiper means may be sealably moved through the liner to close off communication between the liner and well bore through the port means in the first liner wiper portion;

second plug means for effecting a movable seal with said running tool as it moves therethrough;

second wiper means for effecting a movable seal with the liner as it moves therethrough, said second wiper means having means for sealably engaging said second plug means therein; and said second wiper means having a portion extending through the running tool and into the bore thereof to receive said second plug means for movement of said second wiper and plug means together sealably through the liner.

24. The apparatus of claim 23 wherein said first and second wiper means are secured to the running tool member in substantially the same circumferential position and at substantially the same transverse position with respect to the running tool member.

25. The apparatus of claim 23 wherein said first and second wiper means are secured to the running tool in substantially the same circumferential position and at substantially the same transverse position with respect to the running tool member, and wherein said first wiper means is further secured to the running tool at additional circumferentially spaced positions and at substantially the same transverse positions with respect to the running tool at which said second wiper means is secured to the running tool.

26. The apparatus of claim 23 wherein said second wiper means is secured to said running tool member in longitudinally spaced relation to the position at which said first wiper means is secured thereto.

27. The running tool of claim 23 including latch means for latching said first plug means with said first wiper means against premature separation as said engaged lower plug and wiper means move through the liner; and means for catching said first wiper means in the liner after it is moved therethrough.

28. The apparatus of claim 10 wherein said hydraulically actuated seal means includes:

first plug means for effecting a movable seal with said running tool as it moves therethrough;

first wiper means for effecting a movable seal with liner as it moves therethrough, said first wiper means having means for sealably engaging said first lower plug means therein whereby said first plug and wiper means may be sealably moved through the liner to close off communication between the liner and well bore through the port means in the lower liner wiper portion;

second plug means for effecting a movable seal with said running tool as it moves therethrough;

second wiper means for effecting a movable seal with the liner as it moves therethrough, said second wiper means having means for sealably engaging said second plug means therein whereby said second plug and wiper means forms a movable seal with the liner behind the cement as it is discharged into the well bore; and means for releasably securing said first and second wiper means to said running tool member below the smallest internal diameter of said second wiper means, said releasable means being secured with each said first and second wiper means at substantially the same transverse position of said running tool member.

29. The apparatus of claim 10 wherein said hydraulically actuated seal means includes:

first plug means for effecting a movable seal with said running tool as it moves therethrough;

first wiper means for effecting a movable seal with the liner as it moves therethrough, said first wiper means having means for sealably engaging said first lower plug means therein whereby said first plug and wiper means maybe sealably moved through the liner to close off communication between the liner and well bore through the port means in the lower liner wiper portion;

second plug means for effecting a movable seal with said running tool as it moves therethrough;

second wiper means for effecting a movable seal with the liner as it moves therethrough, said second wiper means having means for sealably engaging said second plug means therein whereby said second plug and wiper means forms a movable seal with the liner behind the cement as it is discharged into the well bore; and means for releasably securing said first wiper means adjacent the lower end of said running tool member and said second wiper means so that the longitudinal bore of said second wiper means originates and extends away from adjacent said lower end of said second wiper means.

30. A method of securing and stage cementing a liner in a well bore having a casing by a running tool wherein the liner includes upper and lower liner portions with port means in the upper and in the lower liner portions for communicating with the well bore including the steps of:

releasably locking the upper and lower liner portions together against relative longitudinal movement to maintain the port means closed in the upper portion;

releasably connecting the upper liner portion with the running tool to inhibit premature relative longitudinal movement and disconnection between the running tool and upper liner;

positioning retrievable seal means between the running tool and the upper liner to accommodate axial movement of said running tool relative to the liner while avoiding communication between the inside and outside of the liner throughout the length of the liner below said retrievable seal means and above where cement is discharged from the liner into the well bore;

securing the lower liner portion in the well bore;

manipulating the running tool to disconnect the upper liner portion from the lower liner portion for relative longitudinal movement to open the port means in the upper liner portion to the well bore for discharge of cement thereinto;

manipulating the running tool to close the port means in the upper liner portion and reconnect the upper and lower liner portions against relative longitudinal movement; and manipulating the running tool to disconnect from the liner.

31. The method of claim 30 including the step of maintaining the running tool disconnected from the liner.

32. The method of claim 30 including the step of rotating and/or reciprocating the running tool and connected upper liner a portion while discharging cement through the port means in the upper liner portion.

33. A method of securing and stage cementing a liner in a well bore having a casing by a running tool wherein the liner includes upper and lower liner portions with port means in the upper and in the lower liner portions for communicating with the well bore including the steps of:

releasably locking the upper and lower liner portions together against relative longitudinal movement to maintain the port means closed in the upper portion;

releasably connecting the upper liner portion with the running tool to inhibit premature relative longitudinal movement and disconnection between the running tool and upper liner;

positioning retrievable seal means between the running tool and the upper liner to accommodate axial movement of said running tool relative to the liner while avoiding communication between the inside and outside of the liner throughout the length of the liner below said retrievable seal means and above where cement is discharged from the liner into the well bore;

securing an inflatable packer on the lower liner portion;

closing off the port means in the lower liner portion and securing the lower liner portion in the well bore by inflating the inflatable packer with fluid in the liner to engage the well bore wall;

manipulating the running tool to disconnect the upper liner portion from the lower liner portion for relative longitudinal movement to open the port means in the upper liner portion to the well bore for discharge of cement thereinto;

manipulating the running tool to close the port means in the upper liner portion and reconnect the upper and lower liner portions against relative longitudinal movement; and manipulating the running tool to disconnect from the liner.

34. The method of claim 33 including the step of maintaining the running tool disconnected from the liner.

35. The method of claim 33 including the step of rotating and/or reciprocating the running tool and upper liner portion while discharging cement through the port means in the upper line portion;

36. A method of securing and stage cementing a liner in a well bore having a casing by a running tool wherein the liner includes upper and lower liner portions with port means in the upper and in the lower liner portions for communicating with the well bore including the steps of:

releasably locking the upper and lower liner portions together against relative longitudinal movement to maintain the port means closed in the upper portion;

releasably connecting the upper liner portion with the running tool to inhibit premature relative longitudinal movement and disconnection between the running tool and upper liner;

positioning retrievable seal means between the running tool and the upper liner to accommodate axial movement of said running tool relative to the liner while avoiding communication between the inside and outside of the liner throughout the length of the liner below said retrievable seal means and above where cement is discharged from the liner into the well bore;

discharging cement from the liner into the well bore through the port means in the lower liner portion;

releasing releasable seal means from the operating string and moving the seal means behind the cement as it is discharged into the well bore and to close off the port means in the lower liner portion;

manipulating the running tool to disconnect the upper liner portion from the lower liner portion for relative longitudinal movement to open the port means in the upper liner portion to the well bore for discharge of cement thereinto;

manipulating the running tool to close the port means in the upper liner portion and reconnect the upper and the lower portions against relative longitudinal movement; and manipulating the running tool to disconnect from the liner.

37. The method of claim 36 including the step of maintaining the running tool disconnected from the liner.

38. THe method of claim 36 including the step of rotating a/dor reciprocating the running tool and connected upper and lower liner portions while discharging cement through the port means in the lower liner portion.

39. A method of securing and stage cementing a liner in a well bore having a casing by a running tool wherein the liner includes upper and lower liner portions with port means in the upper and in the lower liner portions for communicating with the well bore including the steps of:

releasably locking the upper and lower liner portions together against relative longitudinal movement to maintain the port means closed in the upper liner portion;

releasably connecting the upper liner portion with the running tool to inhibit premature relative longitudinal movement and disconnection between the running tool and upper liner;

positioning retrievable seal means between the running tool and the upper liner to accommodate axial movement of said running tool relative to the liner while avoiding communication between the inside and outside of the liner throughout the length of the liner below said retrievable seal means and above where cement is discharged from the liner into the well bore;

discharging cement from the liner into the well bore through the port means in the lower liner portion;

releasing releasable seal means from the operating string and moving the seal means behind the cement as it is discharged into the well bore and to close off the port means in the lower liner portion;

manipulating the running tool to disconnect the upper liner portion from the lower liner portion for relative longitudinal movement to open the port means in the upper liner portion to the well bore for discharge of cement thereinto;

reverse circulating from the well bore through the open port means to wash out excess cement in the well bore above the open port means in the upper liner portion;

discharging cement from the upper liner portion open port means into the well bore;

manipulating the running tool to close the port means in the upper liner portion and reconnect the upper and lower liner portions against relative longitudinal movement; and manipulating the running tool to disconnect from the liner.

40. The method of claim 39 including the step of rotating and/or reciprocating the running tool and connected upper liner portion while discharging cement through the port means in the upper liner portion.

41. The method of claim 39 including the step of rotating and/or reciprocating the running tool and connected upper liner portion while discharging cement through the port means in the lower liner portion.

42. The method of claim 36 including the step of rotating and/or reciprocating the running tool and connected lower liner portion while discharging cement through the lower liner portion.

43. The method of claim 36 including the step of rotating and/or reciprocating the running tool and connected upper liner portion while discharging cement through the upper liner portion.

44. The method of claim 33 including the step of rotating and/or reciprocating the running tool and connected upper liner portion while discharging cement through the lower liner portion.

45. The method of claim 30 including the step of rotating and/or reciprocating the running tool and connected upper liner portion while discharging cementing through the port means in the upper liner portion.

46. The apparatus of claim 1, or 10, or 20 including hanger means for securing the liner to the casing in the well bore.

47. The method of claims 30, or 33, or 36, or 39 including the step of manipulating the running tool to secure the liner to the casing prior to disconnecting the running tool from the liner.

* * * * *